US006371392B1

(12) United States Patent
Steinman

(10) Patent No.: US 6,371,392 B1
(45) Date of Patent: Apr. 16, 2002

(54) NOZZLE CONSTRUCTION

(76) Inventor: Lee E. Steinman, 8795 Point Charity Ave., Pigeon, MI (US) 48755

( * ) Notice: Subject to any disclaimer, the term of this patent is extended or adjusted under 35 U.S.C. 154(b) by 0 days.

(21) Appl. No.: 09/585,214

(22) Filed: Jun. 1, 2000

(51) Int. Cl.[7] ..... B05B 1/00

(52) U.S. Cl. ..... 239/602; 239/533.13; 239/542; 239/568; 239/598; 239/DIG. 12

(58) Field of Search ..... 239/106, 107, 239/271, 272, 533.1, 533.13, 542, 547, 550, 568, 597, 598, 601, 602, DIG. 12; 222/494, 575

(56) References Cited

U.S. PATENT DOCUMENTS

| | | | | | |
|---|---|---|---|---|---|
| 167,613 | A | | 9/1875 | Knapp | |
| 603,941 | A | | 5/1898 | Cartwright | |
| 1,636,314 | A | | 7/1927 | Murray | |
| 2,298,668 | A | | 10/1942 | Will | |
| 2,373,555 | A | | 4/1945 | Folke | |
| 2,392,085 | A | * | 1/1946 | Ferrel | 239/533.13 |
| 2,771,320 | A | * | 11/1956 | Korwin | 239/533.13 |
| 3,199,787 | A | | 8/1965 | Oishei et al. | |
| 3,214,102 | A | * | 10/1965 | Meyer | 239/602 X |
| 3,257,046 | A | | 6/1966 | Kasson | |
| 3,269,664 | A | | 8/1966 | Lamb et al. | |
| 3,286,931 | A | | 11/1966 | Webb | |
| 3,351,292 | A | | 11/1967 | Stuart, Sr. | |
| 3,685,735 | A | * | 8/1972 | Foster | 239/542 X |
| 3,899,136 | A | | 8/1975 | Harmony | |
| 3,917,169 | A | | 11/1975 | Harmony | |
| 3,970,251 | A | | 7/1976 | Harmony | |
| 4,099,494 | A | | 7/1978 | Goloff et al. | |
| 4,190,206 | A | | 2/1980 | Atkinson et al. | |
| 4,627,573 | A | * | 12/1986 | Havens et al. | 239/542 |
| 5,054,690 | A | | 10/1991 | Olson | |
| 5,074,471 | A | | 12/1991 | Baumgarten et al. | |

* cited by examiner

*Primary Examiner*—Steven J. Ganey
(74) *Attorney, Agent, or Firm*—Reising, Ethington, Barnes, Kisselle, Learman & McCulloch, P.C.

(57) ABSTRACT

An irrigating nozzle has a tubular body having a bore closed at one end and open at its other end for coupling to a source of irrigating fluid. The body has at least one slit in its side wall and such side wall is formed of elastically deformable material which, in response to the presence of a predetermined pressure within the body, deforms and opens the slit to form a passage through which fluid may flow from the nozzle to the area to be irrigated. Upon reduction of the pressure to a value less than the predetermined value the side wall recovers and the passage is sealed automatically.

15 Claims, 1 Drawing Sheet

NOZZLE CONSTRUCTION

This invention relates to a nozzle construction especially adapted for use in conjunction with irrigating systems.

BACKGROUND OF THE INVENTION

Irrigation systems of the kind utilized in irrigating shrubbery and crops such as vegetables, berries, and small fruit plants conventionally employ nozzles through which water and other materials, such as fertilizer, are sprayed periodically to ensure adequate moisture for the germination and growth of the crops. Such nozzles conventionally have passages through which pressurized fluid flows in response to operation of a pump. The passages in conventional nozzles remain open during periods of inactivity. As a consequence, foreign substances such as mud, ants, and other insects may enter the nozzles and clog the passages.

Conventional nozzles are made from metal or plastic. Metal nozzles are more expensive than plastic nozzles, and plastic nozzles have a tendency to deteriorate over time, especially if they are exposed to sunlight.

Conventional nozzles often are of such kinds as to require the use of fittings to couple the nozzles to the source of irrigating fluids. Such fittings usually are located at uniformally spaced intervals. However, it frequently is desirable to provide a grouping of closely spaced nozzles and to position the groupings at irregularly spaced intervals. This is difficult to accomplish with conventional irrigation systems.

A primary object of the invention is to provide a nozzle construction which overcomes the undesirable characteristics referred to above.

SUMMARY OF THE INVENTION

A nozzle constructed in accordance with the preferred embodiment of the invention comprises a tubular body having a bore open at one end and closed at its opposite end by a closure wall, the body being molded from an elastically deformable material which has high tensile and tear strengths coupled with good elongation characteristics over a wide range of temperatures and which will retain such characteristics over long periods of time. The tubular body has a side wall the thickness of which diminishes in a direction toward the closed end of the bore so that the side wall is thinner adjacent the closed end of the bore than at its open end. However, the closure wall is thicker than the side wall at its juncture with the closure wall.

The side wall is pierced or slit adjacent the closure wall so as to provide a passage through the wall. The passage extends laterally of the side wall and communicates with the bore within the body. The side wall may be provided with more than one slit but in such circumstances the slits are axially displaced from one another.

The open end of the bore accommodates one end of a spigot, the opposite end of which may be inserted into an irrigation conduit via an opening formed in the latter. Preferably, the spigot is threaded at its opposite ends so as to form a watertight connection with the nozzle and the supply conduit, respectively.

The closure wall of the tubular body may have one or more axially extending slits which form passages through the wall.

The material from which the nozzle is formed is of such elasticity that, whenever the pressure of fluid in the nozzle body is less than a predetermined value, the passages formed by the slits are sealed. However, when the pressure is increased to or beyond a predetermined value, the side walls of the nozzle body deform outwardly and the passages formed by the slits open, thereby enabling irrigation fluids to be dispensed through the passages.

Since the thickness of the closure wall is greater than the thickness of the side wall adjacent the slits therein, the passages in the side wall may be open while the passage in the closure wall remains sealed.

THE DRAWINGS

The presently preferred embodiment of the invention is disclosed in the accompanying drawings wherein.

DETAILED DESCRIPTION

Figure 1:
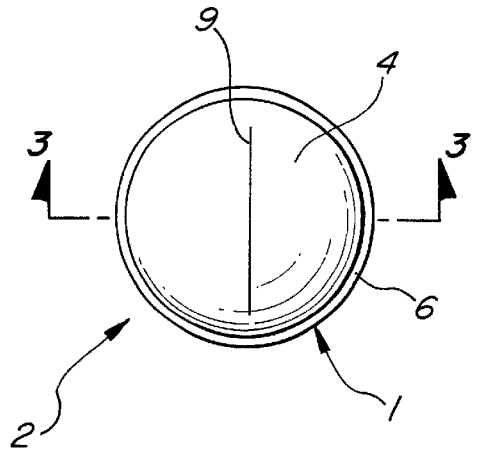
FIG. 1 is a top plan view.
Figure 2:
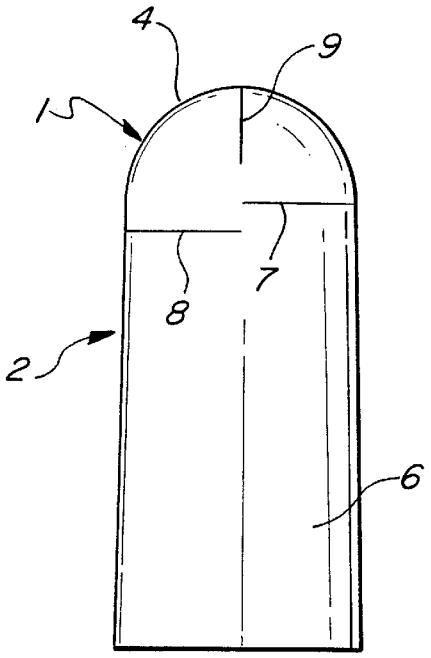
FIG. 2 is a side elevational view.

A nozzle constructed in accordance with the preferred embodiment of the invention is designated generally by the reference character 1 and comprises a tubular body 2 having a bore 3 open at one end and closed at its other end by a convex closure wall 4. Adjacent its open end the bore is restricted by a neck 5. The body 2 has a cylindrical side wall 6 the thickness of which diminishes in a direction from the open end of the bore toward the closure wall 4. As a consequence, the thickness of the side wall 6 is greater adjacent the open end of the bore than it is at its juncture with the closure wall 4. However, the closure wall 4 has a thickness greater than that of the side wall 6 at the juncture of such walls.

The side wall 6 is provided with one or more slits, two of which are shown at 7 and 8 which extend substantially radially inwardly to form self-sealing, uninterrupted arcuate passages which communicate with the bore 3. As shown, each of the slits 7 and 8 occupies a plane substantially perpendicular to the longitudinal axis of the bore and has a circumferential length of about 180°, but the length could be less. Typically, the circumferential length of each slit is between about 30° and 180°. The slits 7 and 8 are formed at that end of the body 2 having the thinner side wall 6. If more than one slit is provided in the nozzle side wall, such slits may be axially spaced, as shown.

Preferably, the closure wall 4 has an axially extending slit 9 forming a passage which communicates with the bore 3 through the wall 4. Although only one slit 9 is shown, another slit could be provided through the wall 4 at right angles to the illustrated slit.

A spigot 11 formed of rigid plastic has one extension 12 threadedly accommodated in the neck 5 and an enlargement 13 accommodated in the bore 3 adjacent its open end. A second threaded extension 14 of the spigot is accommodated in an opening formed at any selected position in a conduit 15 through which irrigating and other fluids may circulate. A grip 16 is provided adjacent the juncture of the extensions 12 and 14 to facilitate manipulation of the spigot when the latter is fitted to the nozzle and to the conduit.

To condition the nozzle for use, the tubular extension 12 is pushed or threaded through the neck 5 of the bore until the enlargement 13 seats on the neck. The material from which the nozzle body 2 is formed is sufficiently deformable as to enable the threads of the extension to pass through the neck. The elasticity of such material is sufficient to enable the neck-forming part of the bore to grip the threads and effect a water-tight seal between the nozzle body and the spigot.

The conduit 15 preferably is formed of a suitable plastic material and is of such size as to enable suitable quantities of liquids to flow at suitable pressures. This makes it possible for an opening to be formed in the wall of the conduit by an awl, for example, so that the extension 14 of the spigot may be threaded into or otherwise secured in communication with the conduit. Accordingly, the bore 3 of the nozzle will be in communication with the interior of the conduit 15 via the hollow spigot 11.

Figure 3:
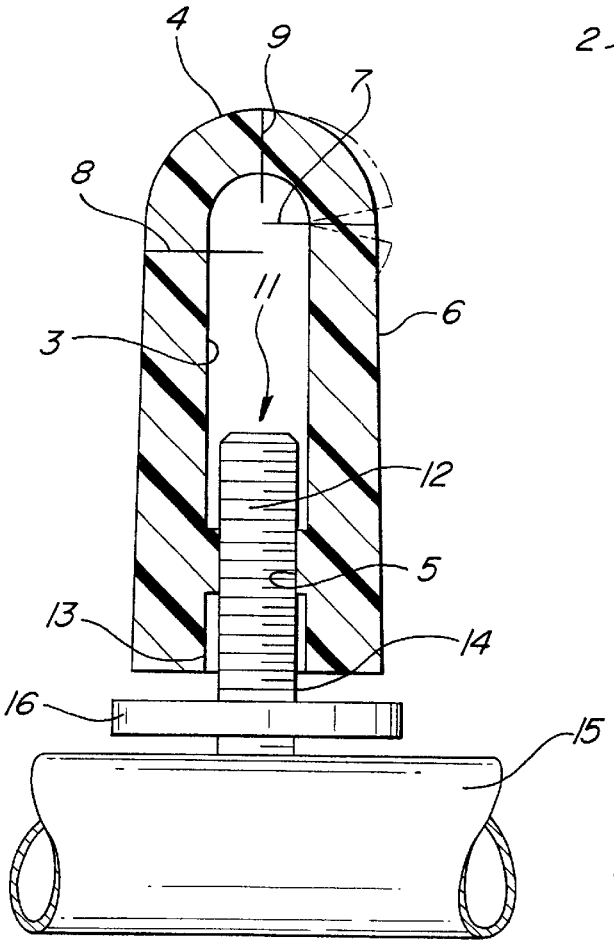
FIG. 3 is a sectional view taken on the line 3—3 of FIG. 1 and illustrating the nozzle coupled to a fluid supply conduit.

In use, liquids under appropriate pressure, such as 5–80 psi, will be able to pass from the conduit 15 through the spigot 11 into the bore 3 of the nozzle. At a suitable, preselected pressure within the bore 3 those portions of the side wall 6 on opposite sides of each of the slits 7 and 8 will be deformed outwardly, as is shown in dash lines in FIG. 3, to form a passage through which liquids from the bore 3 may flow for irrigation purposes.

The thickness of the side wall and the fluid pressure should be so selected that the passages formed by the side wall slits will open, but the passage formed by the closure wall slit or slits 9 will remain closed. For example, a side wall thickness at the slits 7 and 8 of about 0.08–0.09 inch and a closure wall thickness of about 0.11–0.15 inch will ensure that fluids will be discharged only through passages formed by the slit or slits in the side wall of the nozzle. discharged only through passages formed by the slit or slits formed in the side wall of the nozzle.

The area irrigated by a liquid flowing through the passages formed in the nozzle side wall will depend on the pressure of the liquid and on the circumferential length of each slit. If the size of the slit is relatively short or is simply a piercing, the liquid may issue as a mist. If the slit has a greater length, such as 30°, the irrigated area will be a segment somewhat greater than 30° in arcuate length. If the length of the slit is greater, the irrigated area will be correspondingly greater.

The material from which the nozzle is formed has such elasticity that, when the pressure within the nozzle is reduced to a value less than the predetermined value, the deformed portions of the side wall on opposite sides of the slits will recover and resume their normal positions in which the passages are sealed. That is, the material or lips on opposite sides of each slit will seat on each other and seal the passage.

The purpose of the slit or slits 9 in the closure wall 4 of the nozzle primarily is to enable purging of the nozzle. In the unlikely event that insects or other undesirable materials occupy the bore of the nozzle, a person may squeeze the nozzle between his thumb and forefinger and cause the contents of the nozzle to be expelled through passages formed by the slits 9. Upon release of the nozzle it will resume its normal configuration, thereby sealing the passages formed by the slits 9.

Although it is possible to use different kinds of materials, one which has been found satisfactory is liquid silicone rubber sold by Wacker-Chemie GmbH under the trademark ELASTOSIL and bearing the notation LR 3003/70 US.

The disclosed embodiment is representative of a presently preferred form of the invention, but is intended to be illustrative rather than definitive thereof. The invention is defined in the claims.

I claim:

1. A nozzle construction comprising a tubular body having a side wall forming an axially extending bore one end of which is closed by a closure wall and another end of which is open, said side wall being formed of elastically deformable material, said side wall having between said one end and said another end at least one slit extending laterally through said side wall in communication with said bore and forming an uninterrupted, arcuate passage through said side wall, said slit wholly occupying a plane substantially perpendicular to said axis and having a circumferential length of between about 30° and 180°, the material of said side wall being sufficiently elastic to deform adjacent said passage in response to the presence of a predetermined pressure within said bore and open said passage and thereafter to close said passage in response to a reduction in pressure within said bore to less than said predetermined pressure.

2. The construction according to claim 1 wherein said body adjacent said open end of said bore has means for coupling said body to a spigot having an opening therethrough in communication with said bore.

3. The construction according to claim 1 wherein said body is substantially cylindrical.

4. The construction according to claim 3 wherein said at least one passage is formed by a slit extending circumferentially of said body.

5. The construction according to claim 1 wherein said side wall has at least two passages, said at least two passages being circumferentially spaced from one another.

6. The construction according to claim 1 wherein said side wall has at least two of said passages therein, said at least two passages being positioned at axially different levels with respect to said closure wall.

7. The construction according to claim 1 wherein said closure wall has at least one axially extending slit therein forming a self-sealing passage in said closure wall.

8. The construction according to claim 7 wherein said closure wall has a thickness at said self-sealing passage greater than that of said side wall.

9. The construction according to claim 1 wherein said side wall has a thickness which diminishes in a direction toward said closure wall.

10. The construction according to claim 1 wherein said bore has a neck adjacent said open end of said bore for snug accommodation of one end of a spigot.

11. A nozzle construction comprising a tubular body having a cylindrical side wall forming a bore having a longitudinal axis, one end of the bore being closed by a closure wall and another end being open, said side wall being formed of elastically deformable material, said side wall having between said closed end and said another end and adjacent said closed end of said bore at least one continuous slit extending laterally through said side wall in communication with said bore and forming an uninterrupted arcuate passage through said side wall, said slit wholly occupying a plane substantially perpendicular to said axis, the elasticity of the material forming said side wall being sufficient to seal said passage when pressure within said bore is less than a predetermined value, and to enable opening of said passage when pressure within said bore corresponds to and exceeds said predetermined value, said passage having a circumferential length of between about 30° and 180°.

12. The construction according to claim 11 wherein said side wall has at least two passages, said at least two passages being circumferentially spaced from one another.

13. The construction according to claim 12 wherein said at least two passages are axially displaced from one another.

14. The construction according to claim 11 wherein said closure wall has at least one passage therein formed by a slit extending axially into said bore.

15. The construction according to claim 14 wherein said closure wall has a thickness greater than that of said side wall adjacent the slit in said side wall.

* * * * *